US005410565A

United States Patent [19]

Blum et al.

[11] Patent Number: 5,410,565

[45] Date of Patent: Apr. 25, 1995

[54] FURNACE, IN PARTICULAR AN ELECTRIC FURNACE, FOR TREATING LIQUID METAL

[75] Inventors: Jacques Blum, Argancy; François Heckel, Moyeuvre-Grande; Jacques Le Goff, Louvigny; Daniel Pernet, Metz; Dominique Rocchi, Mance, all of France

[73] Assignee: Unimetal Societe Francaise des Aciers Longs, Rombas, France

[21] Appl. No.: 80,524

[22] Filed: Jun. 24, 1993

[30] Foreign Application Priority Data

Jul. 6, 1992 [FR] France ..... 92 08327

[51] Int. Cl.[6] ..... F27D 1/02

[52] U.S. Cl. ..... 373/73; 373/74; 266/158

[58] Field of Search ..... 373/71, 73–77, 373/9, 80; 266/158, 144

[56] References Cited

U.S. PATENT DOCUMENTS

| | | | |
|---|---|---|---|
| 2,684,392 | 7/1954 | Moore | 373/9 |
| 3,576,318 | 4/1971 | Spencer | 373/9 |
| 4,238,632 | 12/1980 | Yasukawa et al. | 373/73 |
| 4,436,290 | 3/1984 | Kilches et al. | 266/158 |
| 4,630,281 | 12/1986 | Nakao . | |

FOREIGN PATENT DOCUMENTS

| | | |
|---|---|---|
| 472146 | 2/1992 | European Pat. Off. . |
| 2665756 | 2/1992 | France . |
| 895300 | 11/1953 | Germany . |
| 1020557 | 12/1957 | Germany . |
| 2357488 | 5/1975 | Germany . |
| 3939383 | 6/1991 | Germany . |
| 2226627 | 7/1990 | United Kingdom . |

*Primary Examiner*—Bruce A. Reynolds
*Assistant Examiner*—Tu Hoang
*Attorney, Agent, or Firm*—Oblon, Spivak, McClelland, Maier & Neustadt

[57] ABSTRACT

The furnace includes a vessel closed by a floating roof, and a sealing means mechanism between the roof and the vessel. The sealing mechanism includes two joint surfaces, one of which is arranged on the peripheral edge portion of the roof whereas the other is arranged on the peripheral edge portion of the vessel. The first surface is substantially toric and the second surface substantially frustoconical. The joint surfaces permit the centering of the roof relative to the axis of the vessel. The peripheral edge portion of the vessel is provided with a coping element on which one of the joint surfaces is arranged.

26 Claims, 2 Drawing Sheets

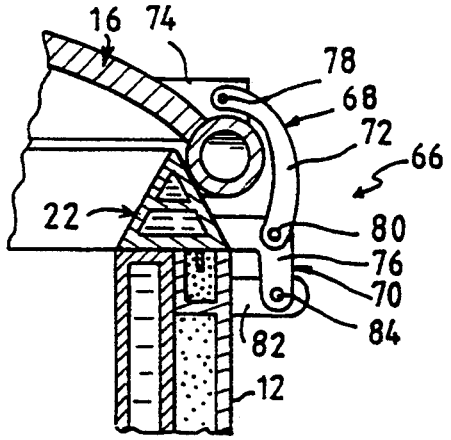
FIG.2
FIG.3
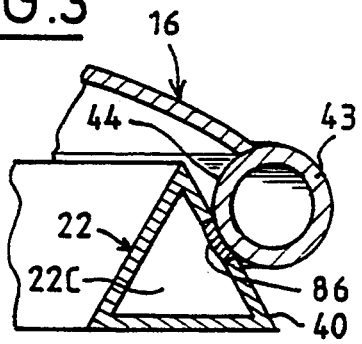
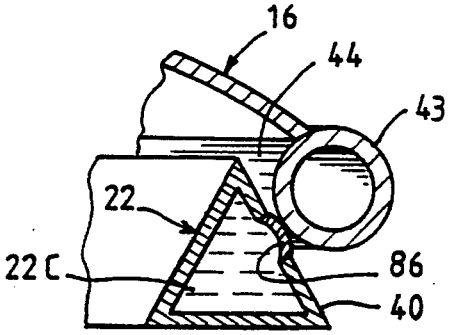
FIG.4
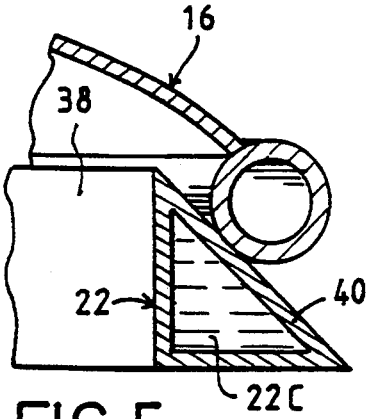
FIG.5
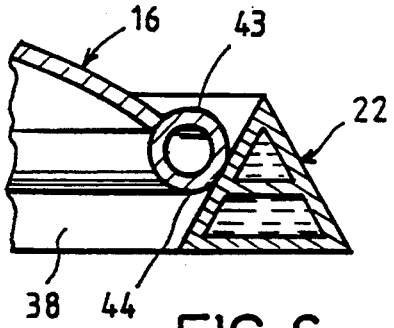
FIG.6
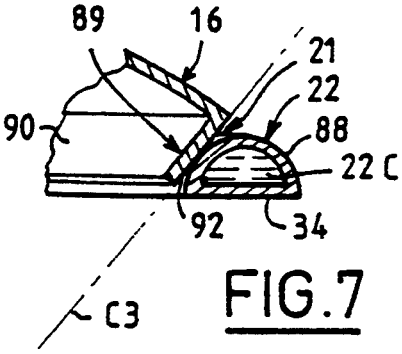
FIG.7
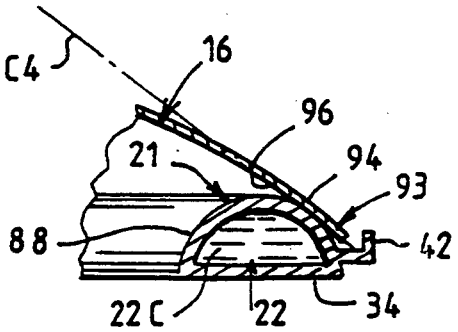
FIG.8

FURNACE, IN PARTICULAR AN ELECTRIC FURNACE, FOR TREATING LIQUID METAL

BACKGROUND OF THE INVENTION

1. Field of the Invention

The present invention relates to a furnace, in particular an electric furnace, for treating liquid metal.

It is in particular applicable to electric arc furnaces employed in the steel industry for producing steels.

2. Discussion of the Background

A furnace is known in the art which comprises a vessel closed by a floating roof.

The floating roof may be raised and displaced for charging the furnace with in particular steel scrap. When the charging has finished, the cover is put back in position on the top of the vessel.

During furnace operation, problems with the seal between the vessel and the floating roof arise.

It is known to ensure the seal between the vessel and the floating roof by means of a joint of sand disposed on the edge portion of the opening of the vessel. Now, owing to the fact that the surface of the sand retains its initial shape when the floating roof is displaced, the joint loses its sealing properties when the roof is again placed on the surface of the sand which no longer closely adapts itself to the shape of the peripheral contour of the roof.

There has therefore been proposed a sealing device between the vessel and the floating roof which comprises a flexible refractory material disposed on the edge portion of the opening of the vessel. This flexible refractory material resumes its initial shape when the roof is raised. Such a sealing device is disclosed in the document FR-A-2 665 756.

In this sealing device, the edge portions of the junction between the floating roof and the vessel are defined by substantially planar and horizontal surfaces. Now, the contact between one planar surface and another planar surface adversely affects the quality of the seal. Further, in the course of the charging of the vessel, steel scrap is deposited on the planar edge portion of the opening of the vessel and this has a harmful effect on the sealing of the furnace when the roof is placed back on the vessel.

SUMMARY OF THE INVENTION

An object of the invention is to overcome these drawbacks and to improve the sealing between the vessel and the floating roof of a furnace, in particular an electric furnace, employed in the steel industry.

The invention therefore provides a furnace, in particular an electric furnace, for treating liquid metal, comprising a vessel closed by a floating roof, and sealing means between the roof and the vessel, characterized in that the sealing means comprise two joint surfaces in direct contact, one of which surfaces is provided on the peripheral edge portion of the roof while the other surface is provided on the peripheral edge portion of the vessel, a first surface being substantially toric and the second surface being substantially frustoconical.

According to other features of the invention:

the peripheral edge portion of the vessel has a detachable coping element on which the joint contact surface of the vessel is arranged;

the base of the coping element includes an annular skirt inserted in the sand contained in a circular channel of the vessel, the skirt and the sand forming a sealing joint between the vessel and the coping element;

the coping element defines at least one annular chamber for the circulation of a cooling liquid;

the coping element includes an elastically yieldable metal diaphragm disposed in the zone of the junction between the coping element and the peripheral edge portion of the roof, the diaphragm being deformed by the pressure of the cooling liquid and thus applied against the peripheral edge portion of the roof;

the furnace comprises detachable connecting means connecting the roof to the coping element and allowing the coping element to be raised together with the roof;

the furnace comprises detachable connecting means connecting the vessel to the coping element.

According to one embodiment of the invention:

the substantially frustoconical surface is arranged on the peripheral edge portion of the vessel and the substantially toric surface is arranged on the peripheral edge portion of the roof;

the substantially frustoconical surface is part of an imaginary cone whose vertex is located substantially above the peripheral edge portion of the vessel.

According to another embodiment of the invention:

the substantially frustoconical surface is arranged on the peripheral edge portion of the roof and the substantially toric surface is arranged on the peripheral edge portion of the vessel.

According to further features of the invention:

the peripheral edge portion of the vessel includes radial projections providing a horizontal stabilization of the roof when the latter is placed in position and arranged on the outer periphery of the vessel substantially in the same transverse plane relative to the axis of the vessel;

the roof includes a nozzle for discharging fumes connected to a fume suction pipe by sealing means comprising a joint of flexible refractory material carried by the junction end of the nozzle with the pipe and applied against the junction end of the pipe with the nozzle, the junction ends of the nozzle and pipe being positioned in facing relation to each other when the roof is placed in position on the vessel;

the junction ends of the nozzle and the pipe are respectively provided with peripheral chambers for the circulation of a cooling liquid.

Embodiments of the invention will be described hereinafter with reference to the accompanying drawings, in which:

FIG. 2 is a partial axial sectional view, taken in a plane other than that of FIG. 1, of the furnace shown in FIG. 1;

FIG. 3 is a detail sectional view, similar to that of FIG. 1, showing a coping element of the vessel according to a second embodiment of the invention, the coping element including an elastically yieldable diaphragm which is not subjected to pressure;

FIG. 4 is a view, similar to FIG. 3, in which the elastically yieldable diaphragm is under pressure;

FIGS. 5 to 8 are detail sectional views, similar to that of FIG. 1, showing different embodiments of the peripheral edge portions of the roof and vessel of a furnace according to the invention.

DESCRIPTION OF THE PREFERRED EMBODIMENT

Figure 1:
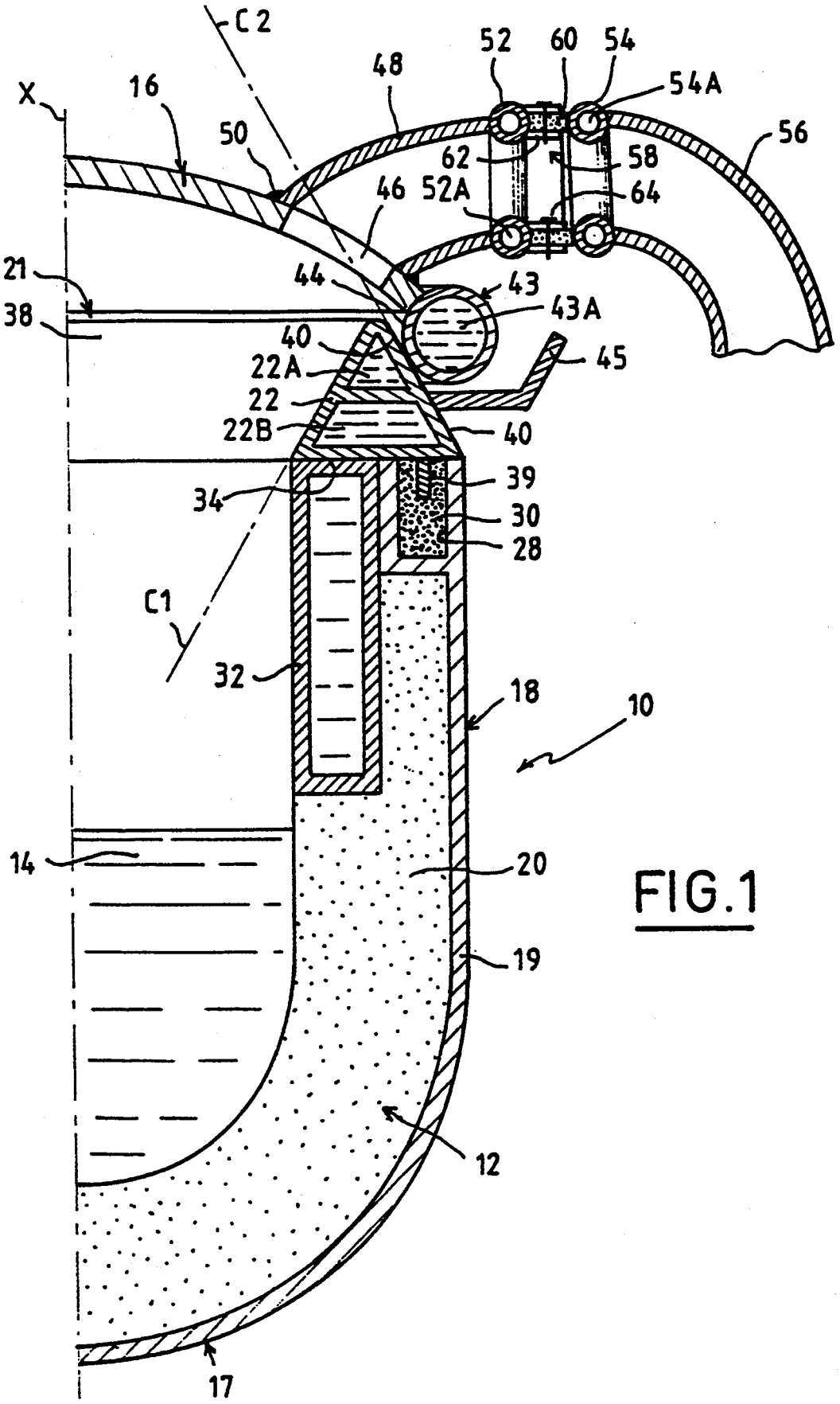
FIG. 1 is a half-axial sectional view of a furnace according to a first embodiment of the invention.

Shown in FIG. 1 is an electric arc furnace according to a first embodiment of the invention, designated by the general reference character 10. This furnace 10 is employed for example in the steel industry for producing steels.

The furnace 10 comprises a vessel 12 containing a liquid metal 14 and closed in its upper part by a floating roof or cover 16.

The vessel 12 has a bottom 17 and a substantially cylindrical shell 18 having an axis X. The wall of the vessel 12 comprises a metal case 19 covered on its inner surface with a refractory material 20.

The peripheral edge portion 21 of the vessel 12 is defined by a detachable annular coping or raised element 22 which bears against the upper edge portion of the shell 18. The coping element 22 is attached to the vessel 12 by devices which are shown in more detail in FIG. 2 and will be subsequently described.

The coping element 22 is defined by metal walls and may be constituted by a single annular element, as shown in FIG. 1, or a plurality of adjoining elements constituting sectors.

The upper edge portion of the metal case 19 defines a circular channel 28 filled with sand 30.

The inner wall of the shell 18 is provided with cooled panels 32 located above the level of the liquid metal 14. These panels 32 have a generally box-like structure and contain a cooling liquid, for example water.

The panels 32 are fixed in the vessel 12 by known means and may be withdrawn from the vessel upwardly as viewed in FIG. 1, after having removed the coping element 22, as will be subsequently described.

The coping element 22 defines two annular cooling chambers 22A, 22B disposed one above the other. These chambers 22A, 22B contain a cooling liquid, for example water, flowing in the chambers in opposite directions.

The annular chambers 22A, 22B are connected to cooling liquid supply circuits of known type (not shown in the drawings). As shown in FIG. 1, the coping element 22 has a substantially triangular section in an axial plane of the vessel containing the axis X.

The upper edge portion of the shell 18 and the base 34 of the coping element bearing against this edge portion, have a substantially planar shape.

The inclined surfaces 38, 40 of the coping element 22 have a generally substantially frustoconical shape.

A first inclined surface 38, facing toward the interior of the vessel, is part of an imaginary cone having a generatrix C1 shown in dot-dash line in FIG. 1. The vertex of this cone C1 is located below the peripheral edge portion 21 of the vessel 12.

The second inclined surface 40, facing toward the exterior of the vessel 12, is part of an imaginary cone having a generatrix C2 shown in dot-dash line in FIG. 1. The vertex of this cone C2 is located above the peripheral edge portion 21 of the vessel 12.

The coping element 22 includes an annular skirt 39 which is connected to the base 34 of the coping element 22 and extends perpendicularly downwardly from this base. The skirt 39 is inserted in the sand 30 so as to form a sealing joint between the shell 18 and the coping element 22.

The roof 16 has a peripheral edge portion 43 which bears against the coping element 22.

It can be seen from FIG. 1 that the edge portion 43 of the roof defines an annular chamber 43A for the circulation of a cooling liquid, for example water. The chamber 43A is connected to a cooling liquid supply circuit of known type.

The chamber 43A may if desired constitute a header of cooling liquid connected to radial cooling pipes (not shown in the drawings) provided in the roof 16.

The edge portion 43 of the roof 16 is defined by a substantially toric or torus-shaped outer surface 44. This surface 44 is in direct contact with the substantially frustoconical surface of the coping element 22.

The contacting surfaces 40, 44 provide the seal between the roof 16 and the vessel 12.

In order to ensure when placing the roof 16 on the vessel 12 a good horizontal stabilization of this roof 16 relative to the coping element 22, the latter includes radial projections 45 or cradles arranged around its outer periphery, substantially in the same transverse plane relative to the axis X of the vessel 12. The free end portions of the cradles 45 are bent upwardly of the vessel 12.

FIG. 1 shows a single cradle 45. Preferably, the coping element 22 has four cradles 45 spaced 90° apart along its outer periphery.

Conventionally, the roof 16 has three openings through which extend vertical electrodes (not shown in the drawings), and a fourth opening 46 for discharging the fumes contained in the furnace.

The opening 46 is connected to a nozzle 48 which is fixed to the roof 16 and projects from the furnace.

The nozzle 48 is fixed to the roof 16 of the furnace by known means, for example a weld bead 50.

The free end 52 of the nozzle 48 is connected to one end 54 of a pipe 56 connected to means for drawing off fumes from the furnace, of a known type (not shown in the drawings). The sectional shapes of the nozzle 48 and pipe 56 are substantially rectangular.

Sealing means 58 are disposed between the junction ends 52, 56 of the nozzle 48 and pipe 56.

The means 58 comprise a sealing element 60 composed of a flexible refractory material which substantially resumes its initial shape after having been compressed. The sealing element 60 is disposed partly in a channel 62 carried by the junction end 52 of the nozzle. The channel 62 has a substantially rectangular sectional shape and extends around the contour of the junction end 52 of the nozzle.

The sealing element 60 is fixed in the channel 62 by detachable fasteners 64 of a known type extending through the lateral walls of the channel 62 and the sealing element 60.

The sealing element 60 projects out of the channel 62 so as to provide a sealed contact against the junction end 52 of the pipe 56.

In the presently-described embodiment, the sealing element 60 comprises a braided fibreglass cord packing having a substantially rectangular section.

As can be seen in FIG. 1, the junction ends 52, 54 of the nozzle and pipe define substantially annular chambers 52A, 54A for the circulation of a cooling liquid, for example water. The chambers 52A, 54A are connected to a cooling circuit of known type (not shown in the drawings).

The pipe 56 includes means (not shown in the drawings) for shifting it in horizontal translation toward or away from the junction end 52 of the nozzle.

FIG. 2 shows a device 66 for interconnecting the vessel 12, the coping element 22 and the roof 16.

The furnace 10 has a plurality of devices 66, for example four, evenly spaced apart along the circumference of the furnace.

The device 66 comprises a connecting device 68 interconnecting the roof 16 and the coping element 22 and a connecting device 70 interconnecting the coping element 22 and the vessel 12.

The device 68 comprises a strap 72 connecting a radial rib 74, fixed to the roof 16, to a bracket 76 which is fixedto the coping element 22 and extends radially outwardly from the vessel 12. The ends of the strap 72 are connected, one to the rib 74 and the other to the bracket 76, by detachable pins 78, 80.

The device 70 comprises a radial lug 82 which is fixed to the vessel 12, extends outwardly from the latter and is connected by a detachable pin 84 to a bent end portion of the bracket 76.

The displacement of the floating roof 16, for example for charging the vessel 12, will now be described.

In a first stage, the pipe 56 for drawing off fumes is shifted away from the junction end 52 of the nozzle 48.

Then the detachable pins 78 of the strap 72 are removed so as to release the roof 16 from the coping element 22 by swinging the straps 72 about the pins 80.

The roof 16 is then displaced by coping it for example by means of a hoisting derrick.

When the cover 16 has been displaced, the vessel 12 can be charged. The vessel 12 may be charged for example with steel scrap. The triangular section of the coping element prevents the steel scrap from being deposited on the peripheral edge portion of the vessel during the charging.

The manner in which the floating roof 16 is placed on the vessel 12 will now be described.

The floating roof 16 is displaced in such manner as to bring it into alignment with the coping element 22. Under the effect of the weight of the roof 16 and owing to the horizontal stabilization cradles 45, the toric surface 44 of the edge portion 43 of the roof fits on the frustoconical surface 40 of the coping element 22.

The frustoconical surface 40 in cooperation with the toric surface 44 provides a good centering of the roof 16 on the axis X of the vessel 12.

When the roof 16 rests against the coping element 22, the region of contact between the toric surface 44 and the frustoconical surface 40 defines a roughly circular line. The contact pressure on this circular line is high so that a sealed joint is achieved between the roof 16 and the vessel 12.

In this configuration, the junction end 52 of the nozzle 48 is substantially in facing relation to the junction end 54 of the pipe 56. Further, the cradles 45 are spaced downwardly from the edge portion 43 of the roof by a small clearance.

The pipe 56 for drawing off fumes is then displaced so as to be put in contact with the sealing element 60 carried by the nozzle 48. The seal between the nozzle 48 and the pipe 56 is achieved by compressing the sealing element 60 against the junction end 54 of the pipe 56.

The connecting device 68 permits displacing the roof 16 together with the coping element 22, in particular when it is desired to replace the cooled panels 32.

In this case, before coping the roof 16 by the usual means, the coping element is connected to the roof by the straps 72 and the pins 78, and the pins 84 normally connecting each bracket 76 to the corresponding lug 82 are removed. Consequently, the coping element 22 merely rests on the vessel 12 and is connected to the roof 16 by the devices 68.

In displacing the roof 16, the coping element 22 is also displaced and this then permits withdrawing the cooled panels 32 upwardly from the vessel by the use of hoisting means of a known type.

A coping element 22 according to a second embodiment of the invention is shown in FIGS. 3 and 4.

In this embodiment, the coping element 22 has only a single chamber 22C for the circulation of cooling liquid. Further, in contrast to the preceding embodiment, the coping element 22 includes an elastically yieldable metal diaphragm 86 located in the region of the junction between the coping element 22 and the peripheral edge portion 43 of the roof 16.

The metal diaphragm 86 is fixed to the coping element 22 by means of a known type.

The metal diaphragm 86 is deformable under the effect of the pressure of the cooling liquid circulating in the chamber 22C.

When the chamber 22C is not supplied with cooling liquid, the metal diaphragm 86 slightly bulges inwardly of the chamber 22C, as shown in FIG. 3.

When the chamber 22C is supplied with cooling liquid under pressure, the metal diaphragm 86 is deformed in such manner as to be applied against the edge portion 43 of the roof 16, since it bulges outwardly of the coping element 22, as shown in FIG. 4.

In this manner, the surface 40 of the coping element 22 has a generally frustoconical shape and the flexibility of the diaphragm enables the coping element to adapt itself in the best possible manner to the toric surface of the edge portion 43 in the event of slight deformations of the latter.

FIG. 5 shows another embodiment of the coping element 22. In this case, the coping element 22 has a section in an axial plane of the vessel, in the shape of a right-angled triangle. The surface 38 of the coping element facing inwardly of the vessel is substantially vertical, and the surface 40 of the coping element facing outwardly of the vessel is substantially frustoconical.

Shown in FIG. 6, is a coping element 22 which is identical to that shown in FIG. 1 on which is placed a roof 16 according to an embodiment other than that shown in the foregoing Figures.

In this case, the toric surface 44 of the edge portion 43 of the roof bears against the frustoconical surface 38 of the coping element facing inwardly of the vessel.

FIGS. 7 and 8 represent a coping element 22 having a substantially semi-circular section in an axial plane of the vessel. In these Figures, the peripheral edge portion of the roof 16 bears against the toric surface 88 of the coping element 22. The latter has a single chamber 22C for the circulation of a cooling liquid.

In FIG. 7, the peripheral edge portion 89 of the roof 16 has a skirt 90 whose surface 92 in contact with the coping element 22 is substantially frustoconical. The surface 92 is part of an imaginary cone having a generatrix C3 shown in dot-dash line in FIG. 7. The vertex of this cone C3 is located substantially below the peripheral edge portion 89 of the roof.

In FIG. 8, the peripheral edge portion 93 of the roof 16 has a skirt 94 whose surface 96 in contact with the coping element 22 is substantially frustoconical. The surface 96 is part of an imaginary cone having a generatrix C4 shown in dot-dash line in FIG. 8. The vertex of the cone C4 is located substantially above the peripheral edge portion 93 of the roof.

Cradles 42 for guiding the roof 16 when placing it in position on the coping element 22 are also shown in FIG. 8.

It must be understood that the scope of the invention is not intended to be limited to the described embodiments.

The coping element 22 may be in one piece with the vessel 12. The chambers for the circulation of water for cooling the coping element and the peripheral edge portion of the roof may be eliminated. Likewise, the devices connecting the roof to the coping element and the devices connecting the coping element to the vessel may be eliminated or replaced by equivalent devices.

The furnace according to the invention has many advantages.

As the coping element is defined by outer frustoconical or toric surfaces, when charging the furnace, there is no accumulation of material, in particular steel scrap, on the edge portion of the coping element adapted to form a seal with the roof.

The frustoconical and toric joint surfaces permit a very easy centering of the roof relative to the axis of the vessel of the furnace and optimize the quality of the seal between the coping element and the roof.

The good centering of the roof relative to the vessel of the furnace permits improving the seal obtained between the nozzle for discharging fumes carried by the roof and the pipe for drawing off the fumes, by ensuring precise positioning of the junction ends of the nozzle and pipe.

The sealing element interposed between the nozzle and the pipe for drawing off the fumes may be rapidly and frequently replaced so that a good seal is always maintained.

What is claimed is:

1. A furnace for treating liquid metal, comprising a vessel having a peripheral edge portion, a floating roof having a peripheral edge portion for closing said vessel, and sealing means between said roof and said vessel, said sealing means comprising two joint contact surfaces in direct contact with each other, one of said surfaces being arranged on said peripheral edge portion of said roof and the other of said surfaces being arranged on said peripheral edge portion of said vessel, a first of said surfaces being substantially toric and a second of said surfaces being substantially frustoconical.

2. Furnace according to claim 1, comprising a detachable coping element disposed on said peripheral edge portion of said vessel, said contact surface of said vessel being arranged on said coping element.

3. Furnace according to claim 2, comprising a circular channel on said vessel, a volume of sand contained in said channel, a base of said coping element including an annular skirt which is inserted in said sand, said skirt and said sand constituting a sealing joint between said vessel and said coping element.

4. Furnace according to claim 2, comprising an annular chamber for the circulation of a cooling liquid within said coping element.

5. Furnace according to claim 4, comprising an elastically yieldable metal diaphragm disposed on said coping element in a region of junction between said coping element and said peripheral edge portion of said roof, said diaphragm being deformed by pressure of said cooling liquid and thus applied against said peripheral edge portion of said roof.

6. Furnace according to claim 2, comprising detachable connecting means for interconnecting said roof and said coping element and permitting the raising of said coping element together with said roof.

7. Furnace according to claim 2, comprising detachable connecting means for interconnecting said vessel and said coping element.

8. Furnace according to claim 1, wherein said substantially frustoconical surface is arranged on said peripheral edge portion of said vessel and said substantially toric surface is arranged on said peripheral edge portion of said roof.

9. Furnace according to claim 8, wherein said substantially frustoconical surface is part of an imaginary cone having a vertex located substantially above said peripheral edge portion of said vessel.

10. Furnace according to claim 1, wherein said substantially frustoconical surface is arranged on said peripheral edge portion of said roof and said substantially toric surface is arranged on said peripheral edge portion of said vessel.

11. Furnace according to claim 1, comprising radial projections providing horizontal stabilization of said roof when said roof is placed in position and arranged on an outer periphery of said vessel substantially in the same transverse plane relative to the axis of said vessel.

12. Furnace according to claim 1, wherein said roof comprises a discharging nozzle for fumes, said nozzle having a junction end, a pipe for drawing off said fumes having a junction end, and sealing means for interconnecting said nozzle and said pipe and comprising a sealing element composed of a flexible refractory material carried by said junction end of said nozzle and applied against said junction end of said pipe, said junction end of said nozzle and said junction end of said pipe being positioned in facing relation to each other when said roof is placed in position on said vessel.

13. Furnace according to claim 12, wherein said junction end of said nozzle and said junction end of said pipe are provided with peripheral chambers for circulation of a cooling liquid.

14. A furnace for treating liquid metal, comprising a vessel having a peripheral edge portion, a floating roof having a peripheral edge portion for closing said vessel, and a sealing mechanism between said roof and said vessel, said sealing mechanism comprising two joint contact surfaces in direct contact with each other, one of said surfaces being arranged on said peripheral edge portion of said roof and the other of said surfaces being arranged on said peripheral edge portion of said vessel, a first of said surfaces being substantially toric and a second of said surfaces being substantially frustoconical.

15. Furnace according to claim 14, comprising a detachable coping element disposed on said peripheral edge portion of said vessel, said contact surface of said vessel being arranged on said coping element.

16. Furnace according to claim 15, comprising a circular channel on said vessel, a volume of sand contained in said channel, a base of said coping element including an annular skirt which is inserted in said sand, said skirt and said sand constituting a sealing joint between said vessel and said coping element.

17. Furnace according to claim 15, comprising an annular chamber for the circulation of a cooling liquid within said coping element.

18. Furnace according to claim 17, comprising an elastically yieldable metal diaphragm disposed on said coping element in a region of junction between said coping element and said peripheral edge portion of said roof, said diaphragm being deformed by pressure of said cooling liquid and thus applied against said peripheral edge portion of said roof.

19. Furnace according to claim 15, comprising a detachable connecting mechanism for interconnecting said roof and said coping element and permitting the raising of said coping element together with said roof.

20. Furnace according to claim 2, comprising a detachable connecting mechanism for interconnecting said vessel and said coping element.

21. Furnace according to claim 14, wherein said substantially frustoconical surface is arranged on said peripheral edge portion of said vessel and said substantially toric surface is arranged on said peripheral edge portion of said roof.

22. Furnace according to claim 21, wherein said substantially frustoconical surface is part of an imaginary cone having a vertex located substantially above said peripheral edge portion of said vessel.

23. Furnace according to claim 14, wherein said substantially frustoconical surface is arranged on said peripheral edge portion of said roof and said substantially toric surface is arranged on said peripheral edge portion of said vessel.

24. Furnace according to claim 14, comprising radial projections providing horizontal stabilization of said roof when said roof is placed in position and arranged on an outer periphery of said vessel substantially in the same transverse plane relative to the axis of said vessel.

25. Furnace according to claim 14, wherein said roof comprises a discharging nozzle for fumes, said nozzle having a junction end, a pipe for drawing off said fumes having a junction end, and a sealing mechanism for interconnecting said nozzle and said pipe and comprising a sealing element composed of a flexible refractory material carried by said junction end of said nozzle and applied against said junction end of said pipe, said junction end of said nozzle and said junction end of said pipe being positioned in facing relation to each other when said roof is placed in position on said vessel.

26. Furnace according to claim 15, wherein said junction end of said nozzle and said junction end of said pipe are provided with peripheral chambers for circulation of a cooling liquid.

* * * * *